United States Patent [19]

Bourgois

[11] 4,158,946

[45] Jun. 26, 1979

[54] METAL CORD

[75] Inventor: Luc Bourgois, Desselgem, Belgium

[73] Assignee: N. V. Bekaert S.A., Zwevegem, Belgium

[21] Appl. No.: 922,110

[22] Filed: Jul. 5, 1978

[30] Foreign Application Priority Data

Jul. 7, 1977 [GB] United Kingdom ..... 28573/77

[51] Int. Cl.[2] ..... D02G 3/48; D07B 1/06

[52] U.S. Cl. ..... 57/213; 57/230; 57/902; 152/359

[58] Field of Search ..... 57/139, 144, 145, 156, 57/160, 149, 147, 148, 152, 212, 213, 214, 230, 902; 152/359

[56] References Cited

U.S. PATENT DOCUMENTS

| | | | |
|---|---|---|---|
| 2,048,450 | 7/1936 | Horn | 57/149 UX |
| 2,492,352 | 12/1949 | Bourbon | 57/902 X |
| 3,195,299 | 7/1965 | Dietz | 57/149 |
| 3,336,744 | 8/1967 | Peene | 57/212 X |
| 3,413,799 | 12/1968 | Lejeune | 57/149 |
| 3,805,508 | 4/1974 | Maderna | 57/145 |
| 3,822,542 | 7/1974 | Naud et al. | 57/145 |
| 3,977,174 | 8/1976 | Boileau | 57/145 |

FOREIGN PATENT DOCUMENTS

| | | | |
|---|---|---|---|
| 562137 | 12/1942 | United Kingdom | 152/359 |

*Primary Examiner*—Donald Watkins
*Attorney, Agent, or Firm*—Edward J. Brenner

[57] ABSTRACT

A metal cord consisting of at least 15 filaments, comprising a core of 2 to 4 filaments twisted together, an intermediate layer wound on the core and in contact therewith and an outer layer of filaments wound on the intermediate layer and in contact therewith, wherein the intermediate and outer layers each have a free space of from 14 to 25%, preferably 20 to 24%.

4 Claims, 4 Drawing Figures

FIG.1
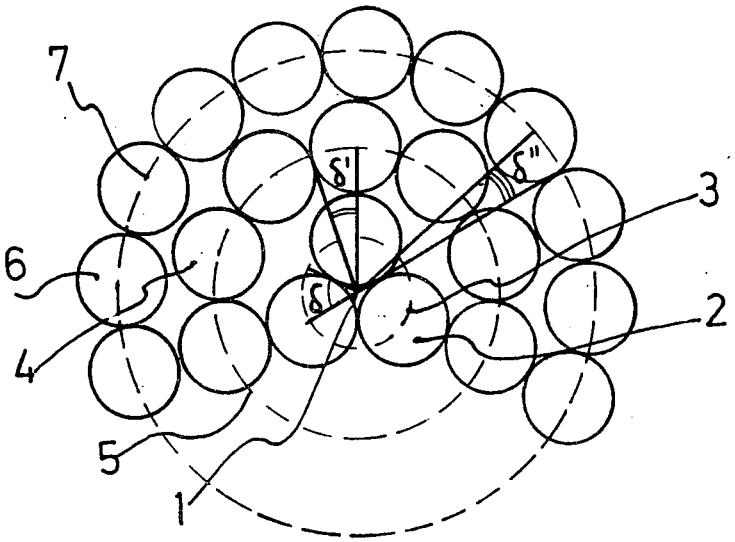
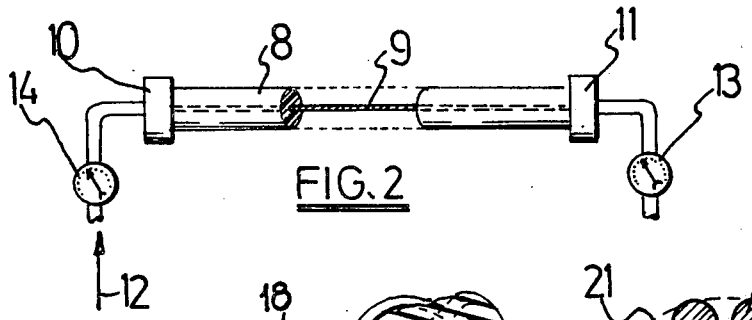
FIG.2
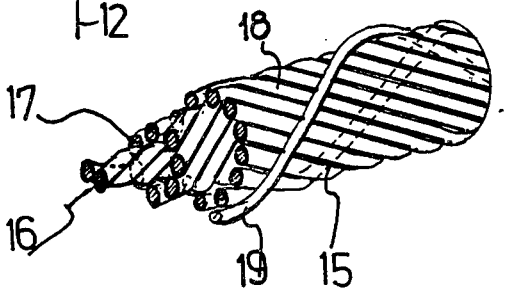
FIG.3
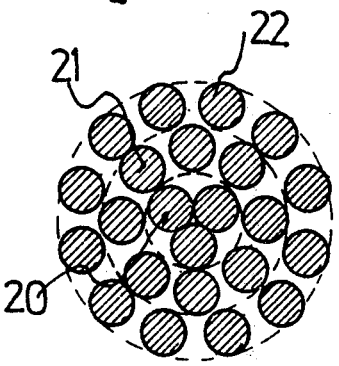
FIG.4

METAL CORD

BACKGROUND OF THE INVENTION

This invention relates to metal cords for use as reinforcement, particularly for reinforcing deformable articles made of elastomeric material such as pneumatic tires, conveyor belts and high pressure hoses, but also usable to reinforce substantially rigid synthetic materials such as polyesters.

When used to reinforce deformable articles such as those just mentioned, such metal cords are subjected to tension stresses, bending, axial compression, internal abrasion, corrosion, fatigue, and other stresses.

An example of a metal cord for such a purpose is shown in British Pat. No. 1,034,327.

In some applications, an improved rubber penetration is desirable in order to avoid adhesion breakdown with consequent corrosion propagation along individual reinforcing cords, resulting in premature destruction of the reinforced body. This type of reinforcement also ensures better adherence of the reinforcing cords to the matrix when used in rigid materials. This difficulty has been avoided in small cords by a 2+7 construction. Cords consisting of three filament layers, in use at present, still suffer from this problem, particularly in the range of intermediate strength cords consisting of from 15 to 27 filaments.

SUMMARY OF THE INVENTION

According to the invention, there is provided a metal cord consisting of at least 15 filaments, comprising a core of 2 to 4 filaments twisted together, a intermediate layer wound on said core and in contact therewith and an outer layer of filaments wound on said intermediate layer and in contact therewith, wherein the intermediate and outer layers each have a free space (as herein defined) of from 14 to 25%.

Cords according to the invention are thus centreless. This is particularly important in cords intended for use in elastomeric articles.

The term "free space" as used in this specification means that proportion of the circumference of the circle containing the axes of the filaments in a layer which is not occupied by the filaments, i.e. consists of spaces between the filaments.

The invention also provides a deformable article made of an elastomeric material reinforced with one or more cord according to the invention.

The invention further provides an article made of a rigid synthetic material reinforce with one or more cords according to the invention.

The cord preferably consists of up to 27 filaments.

The filaments are preferably steel filaments having a diameter of about 1 mm or less and preferably from 0.10 to 0.40 mm, more preferably 0.15 to 0.28 mm, covered with a thin layer of brass or other suitable material. The invention is also particularly applicable to cords of steel filaments, in particular high carbon steel filaments, having an elongation at break of from 1% to 4.5%. The filaments are preferably coated with a material which promotes adherence of the filaments with the material to be reinforced, for example rubber.

The filaments making up the cords are preferably identical, although the filaments of the outer layer may be somewhat smaller than the filaments of the core and the intermediate layer in which case more filaments are used in the outer layer than would be the case if the outer layer consisted of filaments of the same size as the filaments of the core and the intermediate layer. Conversely, the filaments of the outer layer may be larger than the remaining filaments, in which case correspondingly fewer filaments will be required for the outer layer.

BRIEF DESCRIPTION OF THE DRAWINGS

The invention is further described with reference to the accompanying drawings in which:

FIG. 1 shows a conventional three layer cord construction

FIG. 2 shows a method of measuring the amount of rubber penetration.

FIG. 3 shows a perspective view of a 2+7+12+1 construction.

FIG. 4 shows a cross-section of a 3+8+12 construction

DETAILED DESCRIPTION OF THE PREFERRED EMBODIMENT

FIG. 1 shows an example of a conventional construction in order to determine the possible free space left between filaments. For the sake of clarity, only some of the filaments are shown. Around the axis 1, a first layer of filaments 2 is arranged, the axes of which are located on a first pitch circle 3. Around this core strand a second layer of filaments 4 is arranged, the axes of which are located on a second pitch circle 5. Around this second layer a third layer of filaments 6 is arranged, the axes of which are located on a third pitch circle 7. Although the filament cross-sections are shown as circles, the actual cross-section of the filaments is a slight oval, the longer axis depending on the lay angle and the diameter of the corresponding pitch circle, the shorter axis being considered to be equal to the filament size. This correction has to be introduced in order to determine the clearance in the subsequent wire layers.

As shown in FIG. 1, a number of filaments can be arranged along the corresponding pitch circles. Hence the maximum number of filaments is limited by geometrical considerations, each filament covering respectively a $2\delta$, or $2\delta'$ or $2\delta''$ angle of the pitch circles.

The free space between the filaments of the layer is defined as that part of the pitch circle not covered by filaments, expressed as a percentage of the total circumference of the circle. For the core layer the free space is always 0. The diameter of the second pitch circle should be 3 times the filament diameter when the core strand consists of 2 filaments, 3.16 when the core strand consists of 3 filaments and 3.41 when the core strand consists of 4 filaments, and when all filaments have an equal nominal size.

A specific feature of the invention however is to limit the free space in the two outer layers to between 14% and 25% and preferably between 20 and 24%. These figures are based on the nominal geometrical features of the construction. The lower limit is important for penetration, the higher limit for constructional stability. A construction with a core layer consisting of three filaments can accordingly be surrounded by a layer of 8 filaments which will show a free space of about 16%. A surrounding third layer of 12 filaments will leave a free space of about 23.4%. This construction also shows excellent rubber penetration properties.

In this practical example all filaments have the same size, e.g. 0.22 mm. The cord construction denomination will be 3+8+12×0.22. In order to limit the thickness of the cord, the outer filaments can have a 0.20 mm size. In that case the construction denomination is written 3+8×0.22+14×0.20. The free space is then about 16% and 17.5% for the two outer layers respectively. t is also possible for the inner layers to consist of smaller filaments. For instance 3+8×0.22+11×0.25 can be proposed as a possible example with free spaces of 16% and 22.4%, but this is a compromise between fatigue behaviour and economics.

As for lay lengths and lay directions conventional values are used, in particular cases, the core strand has an S lay length of 5 mm, that is, the axial length of one turn of the helix, the intermediate layer an S lay length of 10 mm and the outer layer a Z lay length of 15 mm. An additional spiral wrap of 0.15 mm can be applied with a 3.5 mm S lay length. It is obvious that all different combinations can be considered in this respect.

The use of a similar spiral wrap is common practice to increase the compression resistance and limit the flare tendency of the cord, at the same time allowing an increase in the cord lay length.

Below, a selected group I of constructions is listed, based on filament sizes 0.22 mm and 0.20 mm. In a similar way other cord constructions can be proposed which are composed with other filament size combinations. In the accompanying columns the respective free space left in the second and third filament layer is indicated. A second group II indicates some less preferred constructions in comparison with a conventional 3+9+15×0.22 construction III.

According to the invention, a core layer containing 4 filaments is generally only suitable when its size is smaller than 0.18 mm; the examples shown are expressed in larger sizes in order to compare the constructional features with the items of group I on the same basis.

It is obvious that the free spaces will change with changing filament sizes, and lay lengths.

| | | Free Space | |
|---|---|---|---|
| | | 2nd layer | 3rd layer |
| I | 2+7+12×0.22 | 22.6 % | 21 % |
| | 2+7×0.22+13×0.20 | 22.6 % | 21 % |
| | 2+7×0.22+14×0.20 | 22.6 % | 14.9 % |
| | 3+8+12×0.22 | 16 % | 23.4 |
| | 3+8+13×0.22 | 16 % | 18.0 % |
| | 3+8×0.22+14×0.20 | 16 % | 17.5 % |
| | 3+8×0.22+11×0.25 | 16 % | 22.4 % |
| II | 4+8+13×0.22 | 22 % | 20.7 % |
| | 4+8×0.22+14×0.20 | 22 % | 21.1 % |
| | 4+8×0.22+15×0.20 | 22 % | 15.5 % |
| III | 3+9+15×0.22 | 5.5 % | 3.8 % |

The ability for rubber penetration has been evaluated by means of air pressure resistance of cured samples along the cord axis.

FIG. 2 shows the measuring principle for this penetration. 8 represents a cylindrical rubber rod 220 mm long and 15 mm thick. A piece of cord 9 to be evaluated has been inserted in the middle of the rubber rod before curing.

During curing a pressure of about 150 N/cm$^2$ is applied to the rubber, while time and temperature were such as to obtain between 95 and 99% of the compound branching reaction ability. The pretension of the cord was just sufficient to keep it straight during curing and about 2% of its breaking load.

The two ends of the sample rod are sealed against the two pressure sensing heads 10 and 11. At one side a gas pressure is applied through inlet 12. At the opposite side the sensor 13 indicates if, after gradually raising the pressure, recorded by 14, the sensor 11 also records an increase in pressure above atmospheric pressure.

The pressure ratio is considered to be an indication of the penetration behaviour of the construction, a high pressure difference meaning high penetration. It is also supposed that perfect penetration means that the void spaces in between the filaments are entirely filled with rubber. This is more or less the case for the highest pressure ratios.

Below, several constructions are listed in order of best rubber penetration:

| | | Free space | |
|---|---|---|---|
| Order No. | Construction | 2nd layer | 3rd layer |
| (1) | 2+7+12× 0.175+0.15 | 23.2 | 21.8 |
| (2) | 3+8+12× 0.175+0.15 | 16.4 | 24 |
| (3) | 3+8+13× 0.175+0.15 | 16.4 | 17.7 |
| (4) | 4+8+13× 0.175+0.15 | 22.6 | 21.4 |
| (5) | 2+7+13× 0.175+0.15 | 23.2 | 15.3 |
| (6) | 2+8+12× 0.175+0.15 | 12.3 | 21.8 |
| (7) | 2+8+13× 0.175+0.15 | 12.3 | 15.3 |
| (8) | 3+9+15× 0.175+0.15 | 6 % | 5 % |

All constructions have the same lay lengths and directions and are made with the same processing method.

From number 4 on, the penetration level is not optimal and from number 6 on, the penetration level is inferior and insufficient. It is obvious that changes in manufacturing process can also change the relative order of penetration of corresponding constructions to some extent and the particular behaviour of a new construction has to be evaluated.

As a further illustration of an embodiment of the invention, FIG. 3 shows a cord 15 having a core of two filaments 16 twisted together in an S lay, an intermediate layer of 7 filaments 17 laid in an S lay around the core and a third layer of 12 filaments 18 in a Z lay above the previous ones. An additional, small filament 19 is wound tightly with a short pitch around this cord in order to provide more stable constructional characteristics.

FIG. 4 shows a different arrangement of filaments. The core strand consists of 3 filaments 20, the intermediate layer of 8 filaments 21 and the outer layer of 13 filaments 22. In between the filaments of each layer some space is left to allow a rubber compound to penetrate.

Surprisingly it has been found that the total rubber penetration is dependent on the inside layer arrangement of the cord as well as the outer layer arrangement and accordingly some additional requirements are preferably fulfilled:

the core strand will preferably contain 2 filaments so that the strand does not contain a central hole.

the filaments are preferably all of the same size, because during bending under stress the different filaments will undergo relative movement and act as single individual beams. However, cords in which the filament size in the outer layer is decreased or increased by about 10 percent for geometrical reasons, are within the scope of the invention.

Considerable rubber penetration will still be obtained if the core contains 3 filaments with a size below about 0.25 mm and even 4 filaments if the filament size is limited to about 0.18 mm maximum. The reason for this limitation is to keep the dimensions of the central hole to a minimum in accordance with the viscosity at curing temperature of regular available rubber compounds.

What I claim is:

1. A metallic reinforcement cord for radial tires comprising at least 15 filaments, all made of the same material and having the same modulus of elasticity, the filaments being combined into a core of 2 to 4 filaments stranded together, an intermediate layer wound on said core and in contact therewith with a substantial contact pressure, and an outer layer of filaments wound on said intermediate layer and in contact therewith with a substantial contact pressure, wherein the intermediate and outer layer have a free space of from 14 to 25% allowing rubber penetration into the core during vulcanization.

2. A metallic reinforcement cord as claimed in claim 1 wherein the core consists of two filaments, the intermediate layer of 7 filaments and the outer layer of 12 filaments, all filaments being substantially identical in size and properties.

3. A metallic reinforcement cord as claimed in claim 1, wherein the core consists of three filaments, the intermediate layer consists of 8 filaments, the outer layer consists of 12 filaments, all filaments being substantially identical in properties and size and having a size that is smaller than 0.25 mm.

4. A metallic reinforcement cord as claimed in claim 1, wherein the core consists of four filaments, the intermediate layer consists of 8 filaments and the outer layer of 12 filaments, all filaments being substantially identical in properties and size and having a size that is smaller than 0.18 mm.

* * * * *